US008818242B2

(12) United States Patent
Yamamoto et al.

(10) Patent No.: US 8,818,242 B2
(45) Date of Patent: Aug. 26, 2014

(54) IMAGE FORMING APPARATUS CAPABLE OF PERFORMING ROTATIONAL PHASE CONTROL OF IMAGE BEARING MEMBER

(75) Inventors: Yuichi Yamamoto, Abiko (JP); Hajime Kaji, Abiko (JP)

(73) Assignee: Canon Kabushiki Kaisha (JP)

( * ) Notice: Subject to any disclaimer, the term of this patent is extended or adjusted under 35 U.S.C. 154(b) by 234 days.

(21) Appl. No.: 13/193,708

(22) Filed: Jul. 29, 2011

(65) Prior Publication Data

US 2012/0027465 A1 Feb. 2, 2012

(30) Foreign Application Priority Data

Jul. 30, 2010 (JP) ..... 2010-172199

(51) Int. Cl.
*G03G 15/00* (2006.01)
*G03G 15/01* (2006.01)

(52) U.S. Cl.
CPC .... *G03G 15/0131* (2013.01); *G03G 2215/0158* (2013.01); *G03G 15/5008* (2013.01); *G03G 2215/0129* (2013.01)
USPC ..... 399/167

(58) Field of Classification Search
USPC ..... 399/167
See application file for complete search history.

(56) References Cited

U.S. PATENT DOCUMENTS

2006/0222418 A1* 10/2006 Ebara et al. ..... 399/301

FOREIGN PATENT DOCUMENTS

| | | | |
|---|---|---|---|
| JP | 2001-134039 | A | 5/2001 |
| JP | 2006-258847 | A | 9/2006 |
| JP | 2007-047311 | A | 2/2007 |

OTHER PUBLICATIONS

Korean Office Action cited in Korean counterpart application No. KR10-2011-0072837, dated Dec. 11, 2013.

* cited by examiner

*Primary Examiner* — David Gray
*Assistant Examiner* — Michael Harrison
(74) *Attorney, Agent, or Firm* — Rossi, Kimms & McDowell LLP

(57) ABSTRACT

An image forming apparatus capable of preventing degradation of image quality and reducing time required for rotational phase control. Toner images different in color are formed on a plurality of photosensitive drums, respectively. The toner images are transferred onto an intermediate transfer belt in superimposed relation. A motor controller performs phase control for bringing phases of the respective photosensitive drums into predetermined relation based on a rotational phase difference detected using phase detection sensors. When the rotational phase difference is out of a predetermined range, the motor controller performs the phase control with the photosensitive drums and the intermediate transfer belt separated from each other, whereas when the rotational phase difference is within the predetermined range, the motor controller performs the phase control with the photosensitive drums and the intermediate transfer belt in contact with each other.

6 Claims, 8 Drawing Sheets

IMAGE FORMING APPARATUS CAPABLE OF PERFORMING ROTATIONAL PHASE CONTROL OF IMAGE BEARING MEMBER

BACKGROUND OF THE INVENTION

1. Field of the Invention

The present invention relates to an image forming apparatus, such as a copying machine, a printer, or a facsimile machine, and more particularly to rotational phase control of an image bearing member, such as a photosensitive drum, which is performed by a color image forming apparatus.

2. Description of the Related Art

In recent years, image forming apparatuses (copying machines, printers, facsimile machines, etc.) using an electrophotographic process have been experiencing a shift from a monochrome apparatus (monochrome image forming apparatus) to a color apparatus (color image forming apparatus).

As color image forming apparatuses, there are generally known a so-called single drum type and a so-called tandem type. In a tandem-type color image forming apparatus, toner images in respective colors are formed on respective associated photosensitive drums arranged in a predetermined direction as image bearing members. The toner images in the respective colors are sequentially transferred onto an intermediate transfer member (intermediate transfer belt) as one of image bearing members, whereby a color toner image is formed. Then, the color toner image on the intermediate transfer belt is transferred onto a recording medium (e.g. a recording sheet), whereby a color image is formed. In the tandem-type color image forming apparatus, each photosensitive drum and the intermediate transfer belt both function as image bearing members.

The tandem type is inferior to the single drum type in size and cost reduction. However, the tandem type is capable of performing an image forming operation on a color-by-color basis, and is therefore suited to speed up the image forming operation. For this reason, among the color image forming apparatuses, from the viewpoint of the speed of image formation, the tandem type which can provide substantially the same image forming speed as the monochrome apparatus is drawing more attention.

By the way, since the tandem-type color image forming apparatus has a configuration that toner images of various colors are transferred from the respective photosensitive drums onto the intermediate transfer belt in superimposed relation, there sometimes occurs deviation in position between the color toner images. As a consequence, in the tandem-type color image forming apparatus, color shift occurs, which causes degradation of image quality. In particular, periodic color shift is liable to occur due to run-out of the shaft of each photosensitive drum as a rotary member, irregular rotation of the photosensitive drum, or irregularity of the rotational speed of the intermediate transfer belt.

In order to prevent occurrence of the above-mentioned periodic color shift, it is a practice to control the rotational phases of the respective color photosensitive drums individually.

However, since one of the photosensitive drums and the intermediate transfer belt are in contact with each other during image forming operation, there is a fear that the execution of rotational phase control in the contact state can cause scratching of the photosensitive drum(s) and the intermediate transfer belt due to friction therebetween. If the photosensitive drum(s) and the intermediate transfer belt are scratched, image quality is inevitably degraded.

To prevent such scratching due to friction, there has been proposed a tandem-type image forming apparatus in which when performing adjustment of the rotational phases of respective photosensitive drums, at least photosensitive drums subjected to the adjustment and an intermediate transfer belt are made separate from each other (see Japanese Patent Laid-Open Publication No. 2007-47311).

Further, there has been proposed another tandem-type color image forming apparatus in which to prevent occurrence of scratching even in a state where each of photosensitive drums and an intermediate transfer belt are in contact with each other, rotational phase difference (hereinafter also simply referred to as "phase difference") between photosensitive drums is corrected by causing the photosensitive drums to rotate at respective rotational speeds made different to such an extent that the service life of each of the photosensitive drums and an intermediate transfer belt is not considerably reduced by friction due to differences in rotational speed between the photosensitive drums and the intermediate transfer belt (see Japanese Patent Laid-Open Publication No. 2001-134039).

In the method disclosed in Japanese Patent Laid-Open Publication No. 2007-47311, by performing rotational phase control of the photosensitive drums in a state where the photosensitive drums and the intermediate transfer belt are made separate from each other, it is possible to prevent scratching due to abrasion caused by difference in rotational speed between the photosensitive drums and the intermediate transfer belt. However, it takes time to make the intermediate transfer belt separate from the photosensitive drums and bring the intermediate transfer belt into contact with the photosensitive drums, and as a consequence, it results in an inconvenience that it takes long before an image is transferred onto a recording medium and is output.

On the other hand, in the method disclosed in Japanese Patent Laid-Open Publication No. 2001-134039, it is required to correct phase difference without increasing the rotational speed of each of the photosensitive drums, so as to prevent scratching due to friction. For this reason, when phase differences between the photosensitive drums are large, it takes much time to control the rotational phases of the respective photosensitive drums.

As can be understood from the above, both of the above-described methods have a difficulty in achieving both prevention of scratching (i.e. degradation of image quality) and reduction of time required for rotational phase control at the same time.

SUMMARY OF THE INVENTION

The present invention provides an image forming apparatus which is capable of preventing degradation of image quality and reducing time required for rotational phase control.

In a first aspect of the present invention, there is provided an image forming apparatus comprising a first image bearing member configured to have a toner image formed thereon, a second image bearing member configured to have a toner image formed thereon which is different in color from the toner image formed on the first image bearing member, a transfer member configured to have the toner image formed on the first image bearing member and the toner image formed on the second image bearing member transferred thereon in superimposed relation, a contact unit configured to bring the transfer member into contact with the first image bearing member and the second image bearing member, a phase difference detection unit configured to detect a rotational phase difference between the first image bearing member and the second image bearing member, and a control unit configured to perform phase control for bringing a phase of the first image bearing member and a phase of the second image bearing member into predetermined relation, based on the rotational phase difference detected by the phase difference detection unit, wherein the control unit performs the phase control in a state where the contact is released in a case where the rotational phase difference is out of a predetermined range, and performs the phase control in a state where the contact is kept by the contact unit in a case where the rotational phase difference is within the predetermined range.

In a second aspect of the present invention, there is provided an image forming apparatus comprising a first image bearing member configured to have a toner image formed thereon, a second image bearing member configured have a toner image formed thereon which is different in color from the toner image formed on the first image bearing member, a transfer member configured to have the toner image formed on the first image bearing member and the toner image formed on the second image bearing member transferred thereon in superimposed relation, a contact unit configured to bring the transfer member into contact with the first image bearing member and the second image bearing member, a phase difference detection unit configured to detect a rotational phase difference between the first image bearing member and the second image bearing member, a control unit configured to perform phase control for bringing a phase of the first image bearing member and a phase of the second image bearing member into predetermined relation, based on the rotational phase difference detected by the phase difference detection unit, and a selection unit configured to select one of a first mode for performing the phase control in a state where the contact is released, and a second mode for performing the phase control in a state where the contact is kept by the contact unit, wherein the control unit performs the phase control according to one of the first and second modes selected by the selection unit.

According to the present invention, it is possible to prevent degradation of image quality and reduce time required for rotational phase control.

The features and advantages of the invention will become more apparent from the following detailed description taken in conjunction with the accompanying drawings.

BRIEF DESCRIPTION OF THE DRAWINGS

FIGS. 3A and 3B are views showing a K photosensitive drum appearing in FIG. 1 and components associated therewith, in which FIG. 3A shows the K photosensitive drum as viewed from a side thereof, and FIG. 3B shows the K photosensitive drum as viewed from the rear thereof.

FIGS. 4A and 4B are diagrams useful in explaining synchronization of rotational phases of respective photosensitive drums appearing in FIG. 1, in which FIG. 4A shows a state where the phases of two drum drive motors appearing in FIG. 1 are shifted from each other by 90 degrees, and FIG. 4B shows a state where the two drum drive motors are in phase with each other.

FIGS. 6A and 6B are diagrams useful in explaining operation timing in performing phase control of the drum drive motor for Y, M, and C photosensitive drums and the drive motor for the K photosensitive drum, in which FIG. 6A shows operation timing in a case where the phase of the drum drive motor for the Y, M, and C photosensitive drums precedes that of the drive motor for the K photosensitive drum before the start of the phase control, and hence the phase control is executed after executing separation control, and FIG. 6B shows operation timing in a case where the phase of the drive motor for the K photosensitive drum precedes that of the drum drive motor for the Y, M, and C photosensitive drums before the start of the phase control, and hence the phase control is executed without executing the separation control.

DESCRIPTION OF THE EMBODIMENTS

The present invention will now be described in detail below with reference to the accompanying drawings showing an embodiment thereof.

Figure 1:
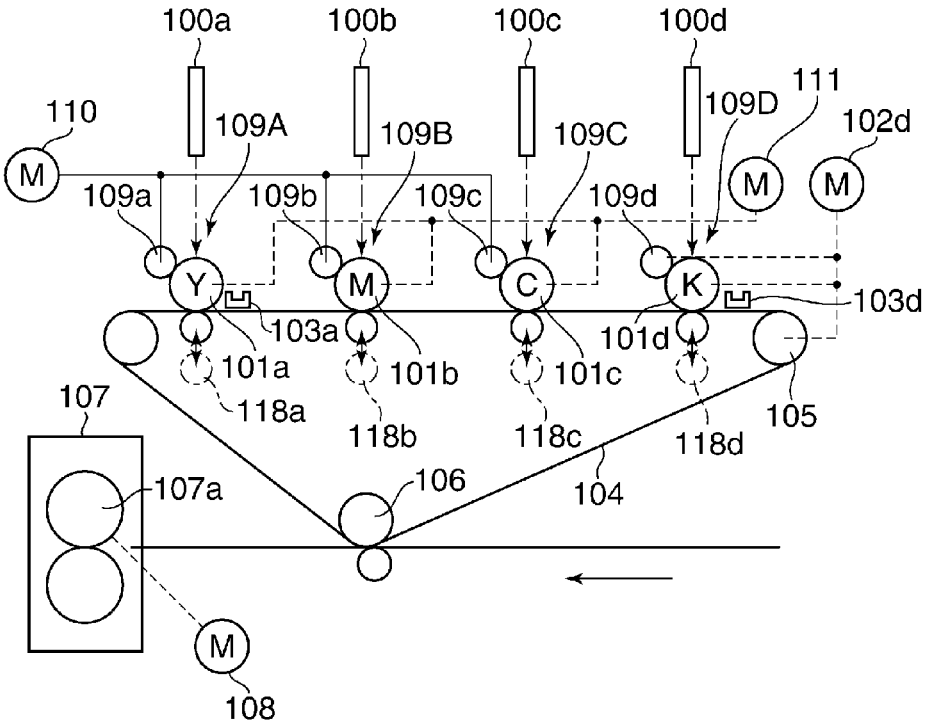
FIG. 1 is a schematic view of a color image forming apparatus according to an embodiment of the present invention.

FIG. 1 is a schematic view of a color image forming apparatus according to the embodiment of the present invention.

The color image forming apparatus shown in FIG. 1 is a so-called tandem type, and has a yellow (Y), magenta (M), cyan (C), and black (K) image forming sections 109A to 109D. The image forming sections 109A to 109D are arranged in the direction of rotation (conveyance) of an intermediate transfer belt 104.

The image forming sections 109A to 109D include respective photosensitive drums 101*a* to 101*d* each of which functions as an image bearing member. In the FIG. 1 example, the photosensitive drums 101*a* to 101*c* are driven for rotation by a drum drive motor 111, while the photosensitive drum 101*d* is driven for rotation by a drum drive motor 102*d*.

Further, the image forming sections 109A to 109D include respective laser scanners 100*a* to 100*d* and respective developing devices 109*a* to 109*d*. Although, not shown, each of the image forming sections 109A to 109D is provided with an electrostatic charger, a cleaner, and so forth.

Each of the developing devices 109*a* to 109*c* incorporates a developing roller (not shown) which is driven by a development drive motor 110. The developing device 109*d* incorporates a developing roller (not shown) which is driven by the drum drive motor 102*d*. A drive roller 105 (hereinafter also referred to as "the intermediate transfer belt roller 105") for driving the intermediate transfer belt 104 is also driven by the drum drive motor 102*d*.

Primary transfer rollers 118*a* to 118*d* are disposed at locations opposed to the respective photosensitive drums 101*a* to 101*d* via the intermediate transfer belt 104. The primary transfer rollers 118*a* to 118*d* are driven by the drum drive motor 102*d* and a separation solenoid 120 (see FIG. 2), as described hereinafter, to positions in contact with or separated from the respective photosensitive drums 101*a* to 101*d* with the intermediate transfer belt 104 therebetween.

Note that when separated from the photosensitive drums 101*a* to 101*d*, the primary transfer rollers 118*a* to 118*d* are positioned at respective locations each indicated by a dotted line. Thus, the intermediate transfer belt 104 is also brought out of contact with (i.e. a state separated from) the photosensitive drums 101*a* to 101*d*.

A phase detection sensor 103*a* is disposed in the image forming section 109A, for detecting the rotational phase of the photosensitive drum 101*a*. The photosensitive drums 101*a* to 101*c*, which are driven for rotation by the drum drive motor 111 as described hereinbefore, always rotate in the same phase. A phase detection sensor 103*d* is disposed in the image forming section 109D, for detecting the rotational phase of the photosensitive drum 101*d*.

The intermediate transfer belt 104 is wound around a secondary transfer roller 106 at a secondary transfer position, and a fixing device 107 is disposed at a location downstream of the secondary transfer position in a direction of conveyance of a recording medium (hereinafter referred to as "a recording sheet" or simply as "a sheet"). A fixing roller 107*a* included in the fixing device 107 is driven for rotation by a fixing drive motor 108.

When a print instruction is given to the color image forming apparatus, Y, M, C, and K image signals are delivered to respective laser scanners 100*a* to 100*d*. When attention is paid to the image forming section 109A, the photosensitive drum 101*a* is rotated counterclockwise as viewed in FIG. 1.

When the surface of the photosensitive drum 101*a* is uniformly charged by an electrostatic charger, the laser scanner 100*a* irradiates the photosensitive drum 101*a* with laser light according to the Y image signal to thereby form an electrostatic latent image on the surface of the photosensitive drum 101*a*.

The electrostatic latent image on the photosensitive drum 101*a* is developed into a Y toner image by the developing device 109*a*. Then, the Y toner image is transferred by the primary transfer roller 118*a* onto the intermediate transfer belt (transfer member) 104 rotated clockwise as viewed in FIG. 1 (primary transfer).

Similarly, an M toner image is formed on the photosensitive drum 101*b*, and the M toner image is transferred onto the intermediate transfer belt 104 by the primary transfer roller 118*b* in a manner superimposed on the Y toner image. Then, after a C toner image formed on the photosensitive drum 101*c* is transferred onto the intermediate transfer belt 104 by the primary transfer roller 118*c*, a K toner image formed on the photosensitive drum 101*d* is transferred onto the intermediate transfer belt 104 by the primary transfer roller 118*d*. Thus, a color toner image (primarily transferred image) is formed on the intermediate transfer belt 104.

Note that residual toner remaining on each of the photosensitive drums 101*a* to 101*d* is removed by the associated cleaner after primary transfer of an associated tone image.

A sheet is conveyed from a sheet cassette (not shown) to the secondary transfer position, as indicated by a solid-line arrow, at a speed synchronized with the conveying speed of the intermediate transfer belt 104. In the secondary transfer position, the color toner image is transferred from the intermediate transfer belt 104 onto the sheet by the secondary transfer roller 106 (secondary transfer). Note that residual toner remaining on the intermediate transfer belt 104 is removed by a belt cleaner (not shown) after the secondary transfer.

After the secondary transfer, the sheet is conveyed to the fixing device 107 and heated by the fixing roller 107*a*. Thus, the color toner image (secondarily transferred image) on the sheet is fixed on the same. Then, the sheet is discharged onto a discharge tray (not shown).

Figure 2:
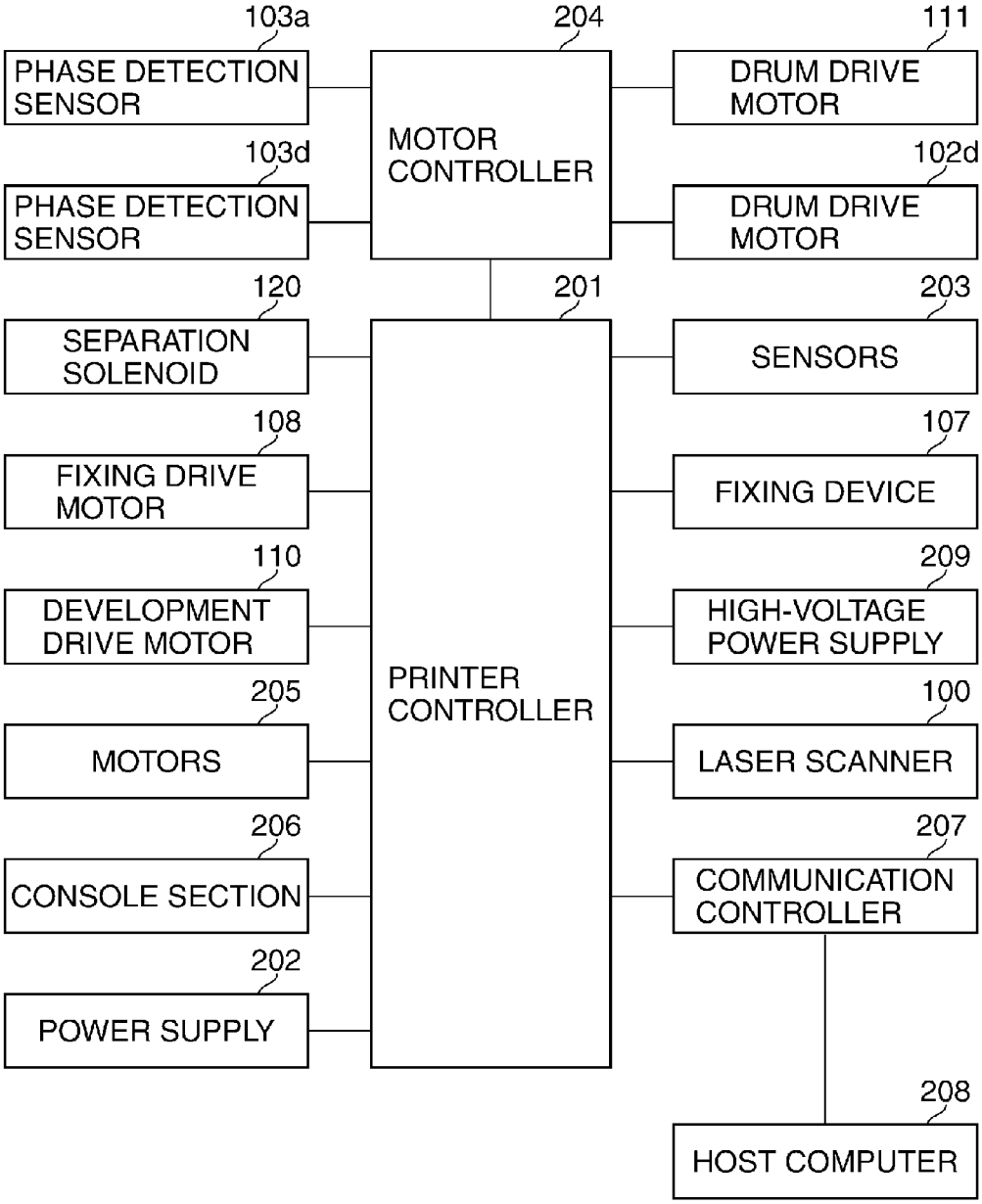
FIG. 2 is a block diagram of a control system of the color image forming apparatus shown in FIG. 1.

FIG. 2 is a block diagram of a control system of the color image forming apparatus shown in FIG. 1.

The control system shown in FIG. 2 includes a printer controller 201 and a motor controller 204. Connected to the motor controller 204 are the phase detection sensors 103*a* and 103*d* and the drum drive motors 111 and 102*d*.

On the other hand, connected to the printer controller 201 are the fixing device 107, the laser scanner 100*a* to 100*d* (generically denoted by reference numeral 100 in FIG. 2), the separation solenoid 120, the fixing drive motor 108, and the development drive motor 110. Further, connected to the printer controller 201 are sensors 203, a high-voltage power supply 209, a communication controller 207, motors 205, a console section 206, and a power supply 202.

The communication controller 207 is connected to an external host computer 208 via a network or the like. The printer controller 201 communicates with the host computer 208 via the communication controller 207 and receives print data from the host computer 208.

The power supply 202 supplies electric power to the electric and electronic components of the image forming apparatus. The sensors 203 each detect a condition (state) of an associated component of the image forming apparatus. The motors 205 each function as a drive source for an associated component of the image forming apparatus which is required to be driven. The console section 206 has a touch panel display for notifying the user of the operating conditions of the image forming apparatus and receiving an operation input from the user.

The motor controller 204 incorporates a DSP, an ASIC, or a CPU, for example. The motor controller 204 performs start and stop control of the drum drive motors 111 and 102*d* according to a control signal given from the printer controller 201. Further, the motor controller 204 compares between a speed command signal given from the printer controller 201 and a detection output from a speed detector (not shown). Then, the motor controller 204 controls the speed of each of the drum drive motors 111 and 102*d* via an associated driver (not shown) based on a result of the comparison.

Further, when it is necessary to control the phases of photosensitive drum, the motor controller 204 controls the speeds of the drum drive motors 111 and 102*d* based on phase detection signals output from the respective phase detection sensors 103*a* and 103*d*.

Figure 3A:
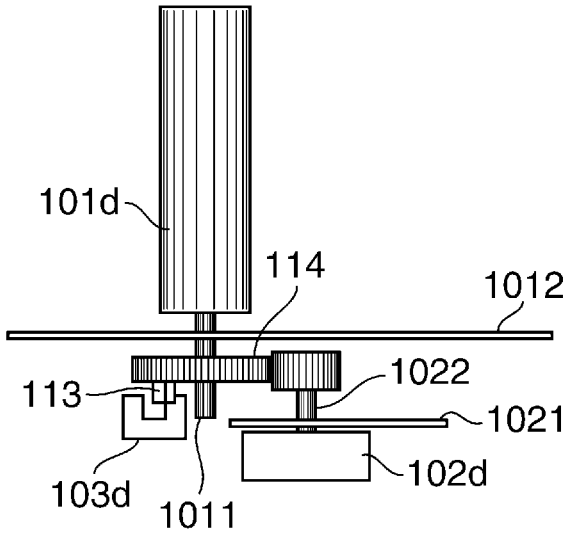
Figure 3B:
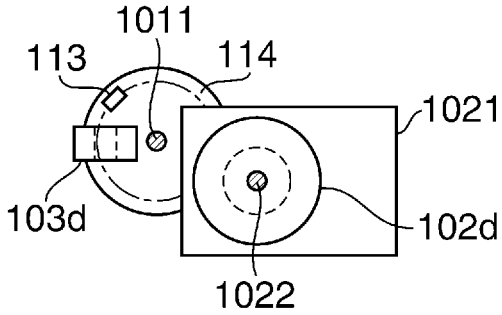

FIGS. 3A and 3B are views showing the K photosensitive drum 101*d* appearing in FIG. 1 and components associated therewith. FIG. 3A shows the K photosensitive drum 101*d* as viewed from a side thereof, and FIG. 3B shows the K photosensitive drum 101*d* as viewed from the rear thereof. Note that components associated with each of the Y photosensitive drum 101*a*, the M photosensitive drum 101*b*, and the C photosensitive drum 101*c* are similar to those in FIGS. 3A and 3B, and therefore the following description will be given by focusing attention on the K photosensitive drum 101*d*.

Referring to FIGS. 3A and 3B, the K photosensitive drum 101*d* has a rotary shaft 1011 rotatably supported by a rotation support member 1012. A drive gear 114 is fitted on the rotary shaft 1011. The drive gear 114 is connected to a rotary shaft 1022 of the drum drive motor 102*d*, and the rotary shaft 1022 is rotatably supported by a rotation support member 1021. With this arrangement, the drum drive motor 102*d* causes rotation of the drive gear 114 to thereby drive the photosensitive drum 101*d* for rotation.

The drive gear 114 is formed with a flag member 113. The flag member 113 moves on a circular locus in accordance with rotation of the drive gear 114, i.e. rotation of the photosensitive drum 101*d*. The phase detection sensor 103*d* is disposed on the locus.

When the photosensitive drum 101*d* performs one rotation, the flag member 113 passes the phase detection sensor 103*d* once to block the optical path of the phase detection sensor 103*d* which comprises a light emitter and a light receiver (neither of which is shown). In short, whenever the photosensitive drum 101*d* performs one rotation, the phase detection sensor 103*d* outputs a phase detection signal.

Note that the flag member 113 may be formed on the rotary shaft 1011 of the photosensitive drum 101*d*, for thereby blocking the optical path of the phase detection sensor 103*d*. Alternatively, a plurality of flag members 113 different in width from each other may be formed. In this case, whenever the photosensitive drum 101*d* performs one rotation, phase detection signals different in pulse width from each other are output a plurality of times.

Figure 4A:
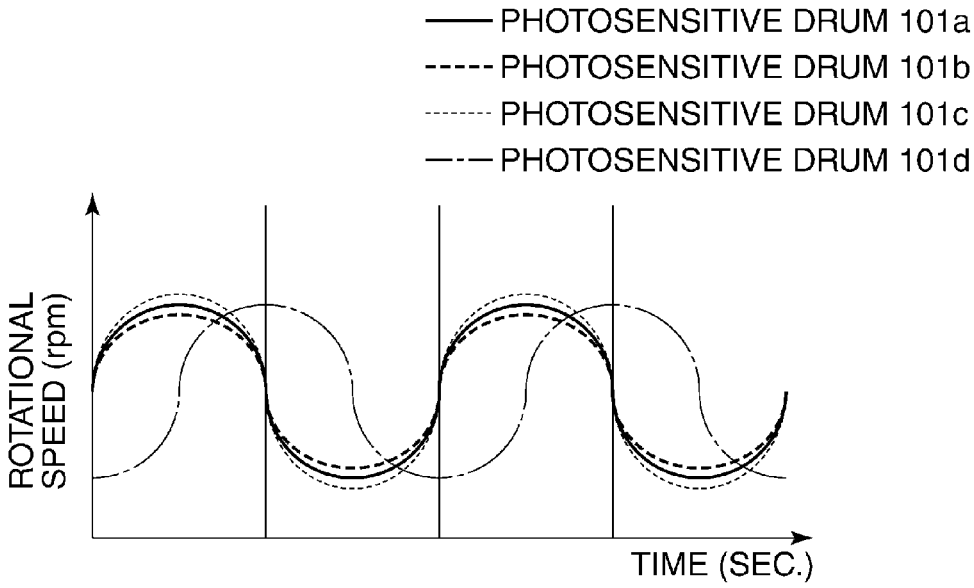
Figure 4B:
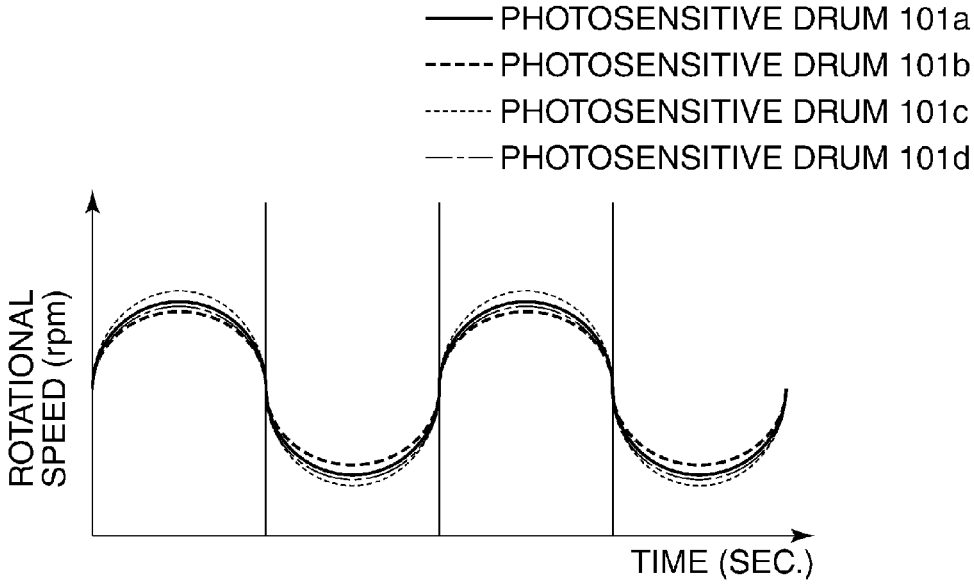

FIGS. 4A and 4B are diagrams useful in explaining synchronization of the rotational phases of the respective photosensitive drums 101*a* to 101*d* appearing in FIG. 1. FIG. 4A shows a state where the phases of the drum drive motors 111 and 102*d* appearing in FIG. 1 are shifted from each other by 90 degrees, and FIG. 4B shows a state where the drum drive motors 111 and 102*d* are in phase with each other.

Referring to FIGS. 4A and 4B, when assembling the image forming apparatus, the photosensitive drums 101*a* to 101*c* are assembled in phase with each other such that eccentric components of the drive gears which are inevitably caused during the manufacturing process are cancelled out. Then, the single drum drive motor 111 drives the photosensitive drums 101*a* to 101*c* to thereby cause them to rotate in phase with each other.

The photosensitive drums 101*a* to 101*c* can be thus rotated in phase with each other. However, the photosensitive drum 101*d* can be considerably shifted in phase from the photosensitive drums 101*a* to 101*c*, as shown in FIG. 4A, since the photosensitive drum 101*d* is driven by the drum drive motor 102*d* different from the drum drive motor 111.

For this reason, the motor controller 204 controls the rotation of each of the drum drive motors 111 and 102*d* based on the phase detection signals output from the respective phase detection sensors 103*a* and 103*d*, as described hereinbefore. This causes the rotational phase shift between the photosensitive drums 101*a* to 101*d* to be eliminated, as shown in FIG. 4B.

Figure 5:
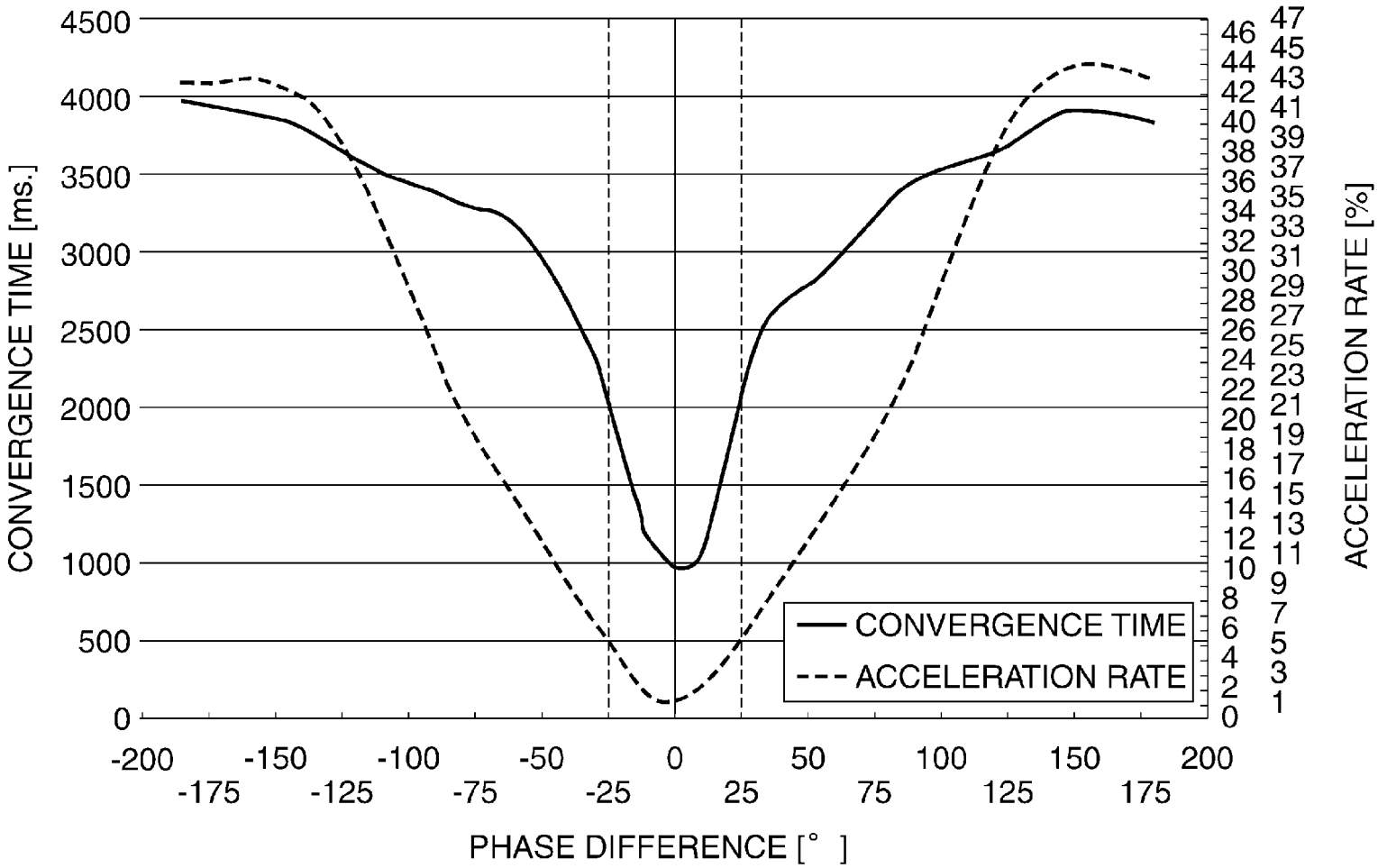
FIG. 5 is a diagram showing the relationship of convergence time and acceleration rate with respect to phase difference exhibited when phase control is performed with the photosensitive drums and an intermediate transfer belt, each appearing in FIG. 1, held in contact with each other.

FIG. 5 is a diagram showing the relationship of convergence time and acceleration rate with respect to phase difference (rotational phase difference) exhibited when phase control is performed with the photosensitive drums 101*a* to 101*d* and an intermediate transfer belt 104, each appearing in FIG. 1, held in contact with each other.

It can be understood from FIG. 5 that as the phase difference between the photosensitive drums 101*a* to 101*c* and the photosensitive drum 101*d* is larger, it takes a longer time period (convergence time) to converge the phase difference. Note that the convergence time is 1000 ms when the phase difference is 0 degree because time taken to detect the phase difference (detection time) is set to 1000 ms. Therefore, if the detection time is reduced, the convergence time can be made shorter.

As for acceleration of the drum drive motors 111 and 102*d*, the acceleration is saturated at a predetermined acceleration rate, and therefore the acceleration rate hardly changes when the phase difference exceeds ±150 degrees.

In the case of the illustrated example, it can be confirmed that if the acceleration rate is not higher than 5% and the convergence time is not longer than 2000 ms (detection time=1000 ms), degradation of image quality does not occur even when phase control is performed with the photosensitive drums 101*a* to 101*d* in contact with the intermediate transfer belt 104 (i.e. in a contact state). The phase difference corresponding to the acceleration rate of 5% and the convergence time of 2000 ms. is ±25 degrees. Therefore, separation control of the photosensitive drums 101*a* to 101*d*, i.e. the primary transfer rollers 118*a* to 118*d* is performed within a phase difference range of ±25 degrees. However, the degradation of image quality varies with the performance of an image forming apparatus, and hence it is necessary to determine a phase difference range suitable for execution of separation control while taking into account the performance of each image forming apparatus.

Figure 6A:
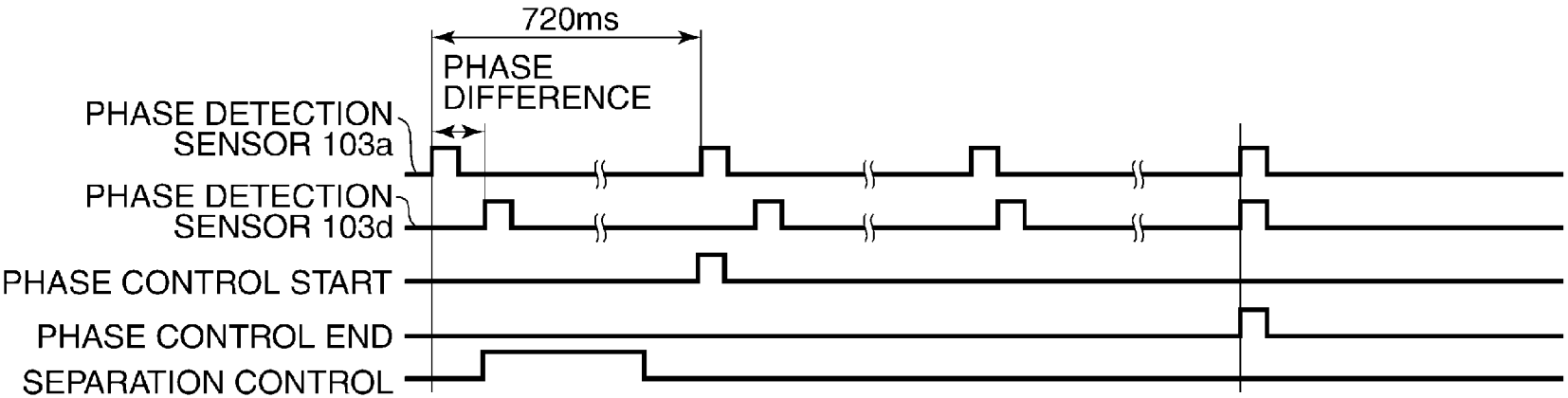
Figure 6B:
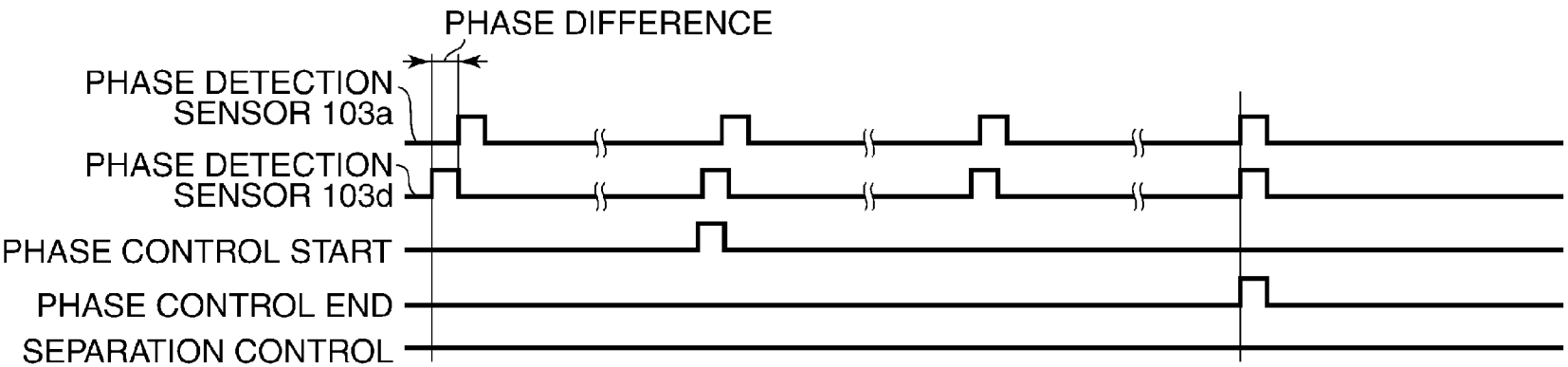

FIGS. 6A and 6B are diagrams useful in explaining operation timing in performing phase control of the drum drive motors 111 and 102*d*. FIG. 6A shows operation timing in a case where the phase of the drum drive motor 111 precedes that of the drum drive motor 102*d* before the start of the phase control, and hence the phase control is executed after executing the separation control. FIG. 6B shows operation timing in a case where the phase of the drum drive motor 102*d* precedes that of the drum drive motor 111 before the start of the phase control, and hence the phase control is executed without executing the separation control. Note that in both of the FIGS. 6A and 6B cases, the phase difference falls within the range of ±25 degrees.

Referring to FIGS. 2 and 6A, the motor controller 204 detects the rotational phase difference between the photosensitive drum 101*a* which represents the photosensitive drums 101*a* to 101*c* and is in phase with the photosensitive drums 101*b* and 101*c* and the photosensitive drum 101*d* as a detected rotational phase difference, using the phase detection sensors 103*a* and 103*d*. After having detected the rotational phase difference, the motor controller 204 determines whether or not it is necessary to separate the intermediate transfer belt 104 from the photosensitive drums 101*a* to 101*d*. In this case, when the rotational phase difference exceeds a predetermined phase difference threshold value (e.g. ±25 degrees), the motor controller 204 determines that it is necessary to separate the intermediate transfer belt 104 from the photosensitive drums 101*a* to 101*d*.

If it is necessary to separate the intermediate transfer belt 104 from the photosensitive drums 101*a* to 101*d*, the motor controller 204 notifies the printer controller 201 of the fact. In response to this, the printer controller 201 executes the separation control of the primary transfer rollers 118*a* to 118*d* (i.e. the primary transfer rollers 118*a* to 118*d* are moved to the separate position indicated by the respective dotted lines in FIG. 1).

When the separation control is completed, the printer controller 201 outputs a phase control start signal to the motor controller 204. In response to this phase control start signal, the motor controller 204 accelerates or decelerates the drum drive motor 111 or 102*d* such that the rotational phase difference between the photosensitive drums 101*a* to 101*c* and the photosensitive drum 101*d* becomes equal to 0 degree.

In an example shown in FIG. 6A, the rotation of the photosensitive drum 101*d* is slower than those of the photosensitive drums 101*a* to 101*c*, so that when the phase control start signal is output, the motor controller 204 accelerates the drum drive motor 102*d* or decelerates the drum drive motor 111 such that the rotational phase difference between the drum drive motors 111 and 102*d* becomes equal to 0 degree. Then, when the rotational phase of the photosensitive drum 101*a* which represents the photosensitive drums 101*a* to 101*c* and is in phase with the photosensitive drums 101*b* and 101*c* and the rotational phase of the photosensitive drum 101*d* become equal to each other according to the phase detection signals output from the respective phase detection sensors 103*a* and 103*d*, the motor controller 204 outputs a phase control end signal to the printer controller 201.

The phase control end signal causes the printer controller 201 to proceed to next processing. For example, the printer controller 201 moves each of the primary transfer rollers 118*a* to 118*d* from the separate position to a contact position indicated by a solid line in FIG. 1, to thereby bring the photosensitive drums 101*a* to 101*d* into contact with the intermediate transfer belt 104.

Next, a description will be given with reference to FIGS. 2 and 6B. The motor controller 204 detects the rotational phase difference between the photosensitive drum 101*a* which represents the photosensitive drums 101*a* to 101*c* and is in phase with the photosensitive drums 101*b* and 101*c* and the photosensitive drum 101*d* using the phase detection sensors 103*a* and 103*d*. After having detected the rotational phase difference, the motor controller 204 determines, as described hereinbefore, whether or not it is necessary to separate the intermediate transfer belt 104 from the photosensitive drums 101*a* to 101*d*.

If it is necessary to separate the intermediate transfer belt 104 from the photosensitive drums 101*a* to 101*d*, the motor controller 204 notifies the printer controller 201 of the fact. In an example shown in FIG. 6B, the printer controller 201 outputs the phase control start signal to the motor controller 204 without executing the above-described separation control. In response to this phase control start signal, the motor controller 204 accelerates or decelerates the drum drive motor 111 or 102*d* such that the rotational phase difference between the photosensitive drum 101*a* which represents the photosensitive drums 101*a* to 101*c* and is in phase with the photosensitive drums 101*b* and 101*c* and the photosensitive drum 101*d* becomes equal to 0 degree.

In the FIG. 6B example, the rotation of each of the photosensitive drums 101*a* to 101*c* is slower than that of the photosensitive drum 101*d*, so that when the phase control start signal is output, the motor controller 204 decelerates the drum drive motor 102*d* or accelerates the drum drive motor 111 such that the rotational phase difference between the drum drive motors 111 and 102*d* becomes equal to 0 degree. Then, when it is determined based on the phase detection signals output from the respective phase detection sensors 103*a* and 103*d* that the rotational phase of the photosensitive drum 101*a* which represents the photosensitive drums 101*a* to 101*c* and is in phase with the photosensitive drums 101*b* and 101*c* and the rotational phase of the photosensitive drum 101*d* become equal to each other, the motor controller 204 outputs the phase control end signal to the printer controller 201. This causes the printer controller 201 to proceed to the next processing.

Next, a description will be given of the phase control of the photosensitive drums 101*a* to 101*d* and the contact/separation control of the photosensitive drums 101*a* to 101*d* and the intermediate transfer belt 104, which are executed during post-processing after execution of an image forming operation by the image forming apparatus.

Figure 7:
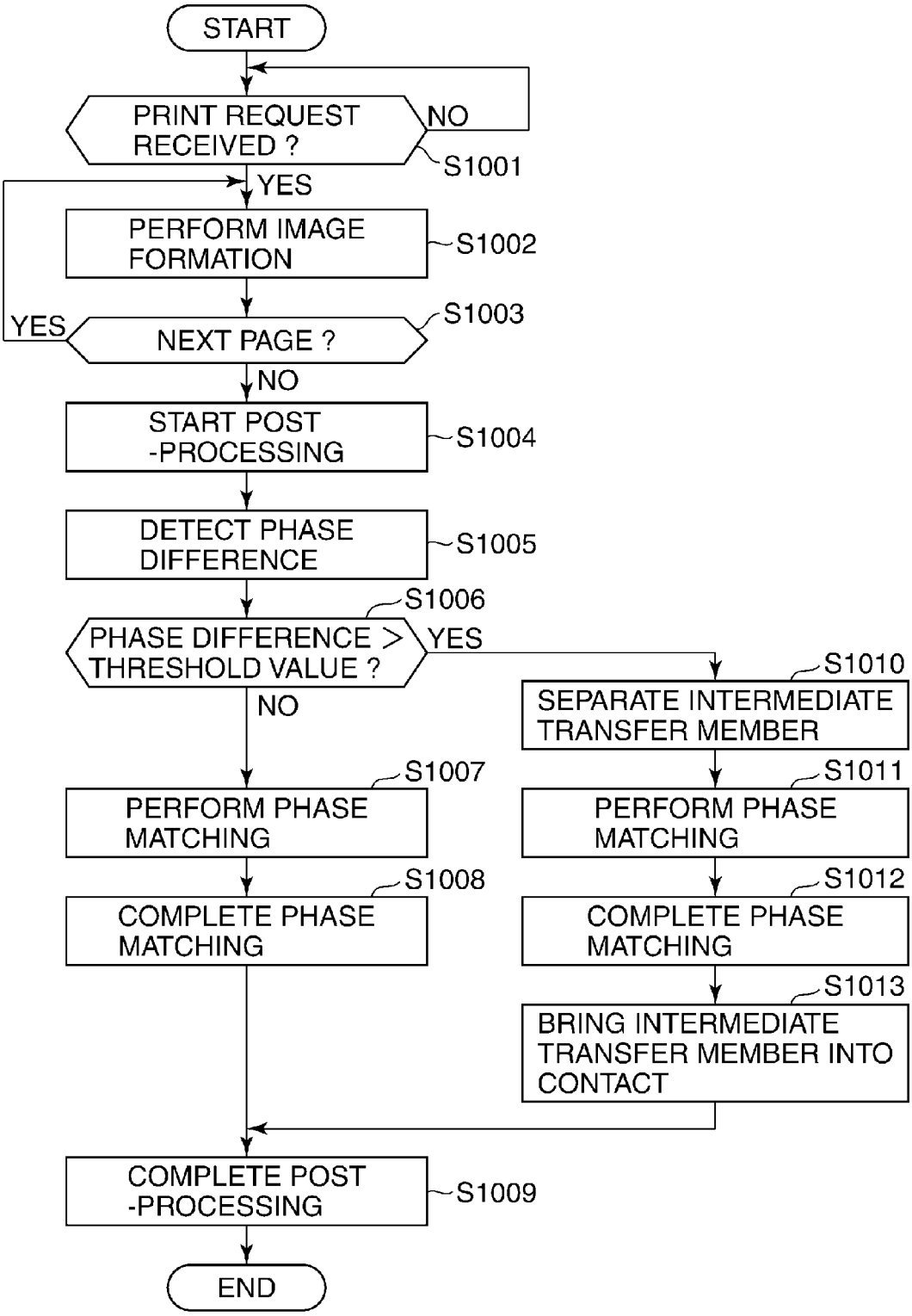
FIG. 7 is a flowchart of a control process which is performed during post-processing after execution of an image forming operation by the image forming apparatus shown in FIG. 1, for photosensitive drum phase control and contact/separation control of the photosensitive drums and the intermediate transfer belt.

FIG. 7 is a flowchart of a control process which is performed during post-processing after execution of an image forming operation by the image forming apparatus shown in FIG. 1, for the phase control of the photosensitive drums 101*a* to 101*d* and the contact/separation control of the photosensitive drums 101*a* to 101*d* and the intermediate transfer belt 104.

Referring to FIGS. 1, 2, and 7, the printer controller 201 monitors whether or not a print request has been received from the host computer 208 or from the console section 206 (step S1001). If a print request has not been received (NO to the step S1001), the printer controller 201 is kept on standby.

On the other hand, if a print request has been received (YES to the step S1001), the printer controller 201 performs preprocessing necessary for an image forming operation (printing) based on the print request and then starts the image forming operation based on image data (step S1002).

After completion of printing of a first page, the printer controller 201 determines whether or not there is a page to be printed next (step S1003). If there is a next page to be printed (YES to the step S1003), the printer controller 201 returns the process to the step S1002 and continues processing.

If there is no page to be printed next (NO to the step S1003), the printer controller 201 performs post-processing, such as removal of residual electric charge on the photosensitive drums 101*a* to 101*d* and cleaning inside the image forming apparatus (step S1004). During this post-processing, the printer controller 201 executes the phase control of the drum drive motors 111 and 102*d*.

First, the printer controller 201 gives a phase control start command to the motor controller 204. In response to this, the motor controller 204 detects the phase difference in rotation (rotational phase difference) between the photosensitive drums 101*a* to 101*d* (step S1005), as described hereinbefore. Then, the motor controller 204 compares between the detected phase difference and a phase difference threshold value (e.g. ±25 degrees) (step S1006).

If the rotational phase difference is not larger than the phase difference threshold value (NO to the step S1006), the motor controller 204 notifies the printer controller 201 that the separation control is not required. According to the notification, the printer controller 201 refrains from performing the separation control of the photosensitive drums 101*a* to 101*d* and the intermediate transfer belt 104 (i.e. the printer controller 201 maintains the contact state), as described hereinbefore. As a consequence, the motor controller 204 causes the rotational phases of the respective photosensitive drums 101*a* to 101*d* to match each other, in a state where the photosensitive drums 101*a* to 101*d* are in contact with the intermediate transfer belt 104, as described hereinbefore (step S1007). Then, after the rotational phase adjustment (phase matching) is completed (step S1008) and the post-processing including the removal of residual electric charge on the photosensitive drums 101*a* to 101*d* and cleaning within the image forming apparatus is completed (step S1009), the printer controller 201 terminates the present process.

On the other hand, if the detected rotational phase difference is larger than the phase difference threshold value (YES to the step S1006), the motor controller 204 determines that separation between the photosensitive drums 101*a* to 101*d* and the intermediate transfer belt 104 is required. That is, when the rotational phase difference is larger than the phase difference threshold value, there is a strong fear that the execution of rotational phase control in the state where the photosensitive drums 101*a* to 101*d* are in contact with the intermediate transfer belt 104 causes scratching of the photosensitive drums 101*a* to 101*d* and the intermediate transfer belt 104 due to friction therebetween. Therefore, in the case of performing rotational phase control, the motor controller 204 notifies the printer controller 201 that the separation control is required.

As a consequence, the printer controller 201 performs the separation control for separating between the photosensitive drums 101*a* to 101*d* and the intermediate transfer belt 104

(step S1010). Thereafter, the phase control start signal is delivered from the printer controller 201 to the motor controller 204 as described hereinbefore. Then, the motor controller 204 causes the rotational phases of the respective photosensitive drums 101*a* to 101*d* to match each other, in the state where the photosensitive drums 101*a* to 101*d* are separated from the intermediate transfer belt 104, as described hereinbefore (step S1011).

After completion of the rotational phase adjustment (phase matching) (step S1012), the motor controller 204 notifies the printer controller 201 that the phase control has been completed. According to the notification, the printer controller 201 brings the photosensitive drums 101*a* to 101*d* into contact with the intermediate transfer belt 104 (step S1013), and then proceeds to the step S1009.

Next, a description will be given of a variation of the phase control of the photosensitive drums 101*a* to 101*d* and the contact/separation control of the photosensitive drums 101*a* to 101*d* and the intermediate transfer belt 104 which are executed during pre-processing performed prior to the start of an image forming operation by the image forming apparatus.

Figure 8:
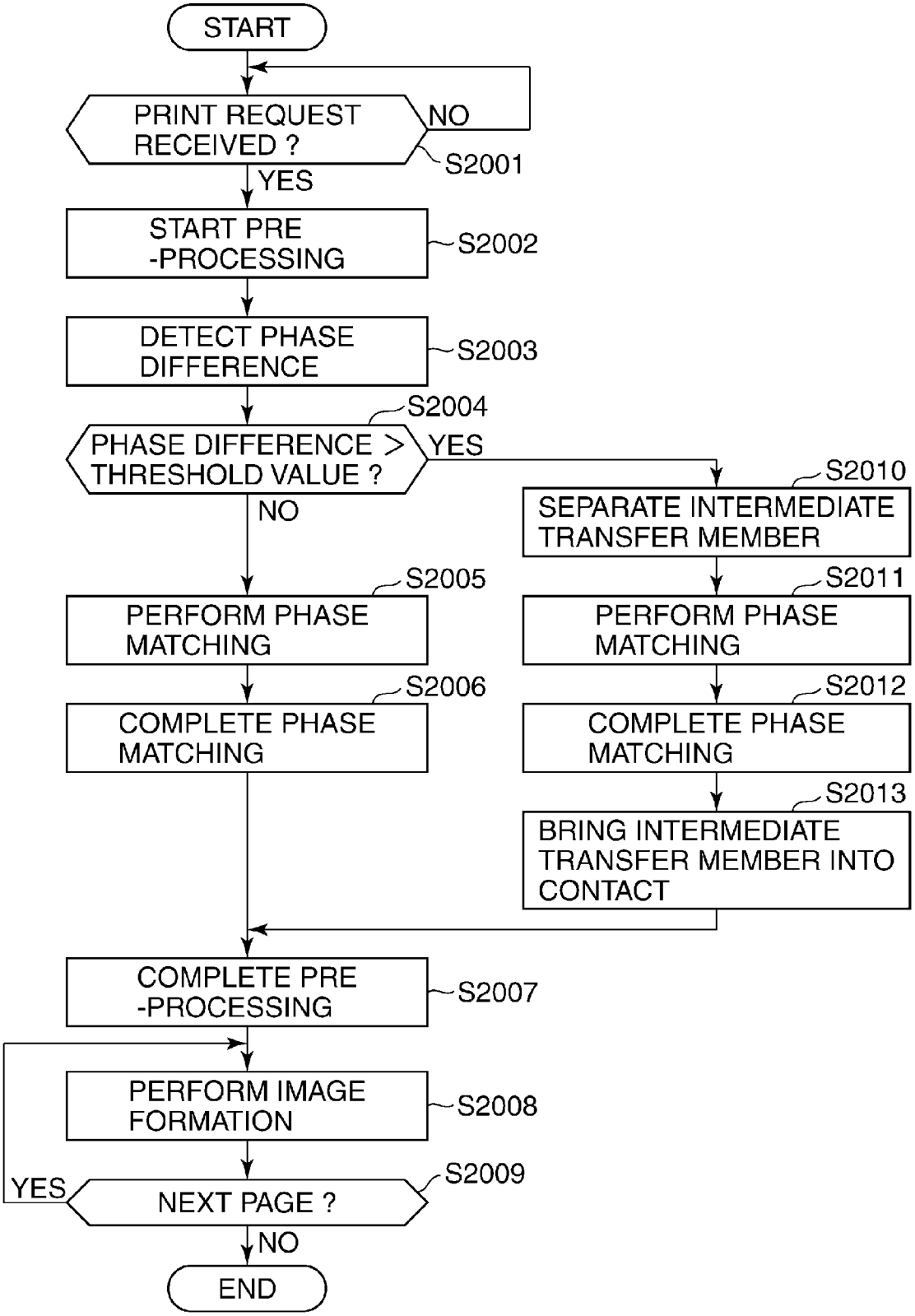
FIG. 8 is a flowchart of a control process as a variation of the FIG. 7 control process, which is performed during preprocessing prior to the start of an image forming operation by the image forming apparatus shown in FIG. 1, for photosensitive drum phase control and contact/separation control of the photosensitive drums and the intermediate transfer belt.

FIG. 8 is a flowchart of a control process as a variation of the FIG. 7 control process, which is performed during pre-processing prior to the start of an image forming operation by the image forming apparatus shown in FIG. 1, for the phase control of the photosensitive drums 101*a* to 101*d* and the contact/separation control of the photosensitive drums 101*a* to 101*d* and the intermediate transfer belt 104.

Referring to FIGS. 1, 2, and 8, the printer controller 201 monitors whether or not a print request has been received from the host computer 208 or from the console section 206 (step S2001). If a print request has not been received (NO to the step S2001), the printer controller 201 is kept on standby.

On the other hand, if a print request has been received (YES to the step S2001), the printer controller 201 starts pre-processing, including high-voltage power supply startup processing and startup processing for starting up drive sources including the drive motors 102*d*, 110 and 111, which is required for an image forming operation (step S2002). In this pre-processing, the printer controller 201 performs the phase control of the drum drive motors 111 and 102*d*.

First, the printer controller 201 gives the phase control start command to the motor controller 204. In response to this, the motor controller 204 detects the rotational phase difference between the photosensitive drums 101*a* representing the photosensitive drums 101*a* to 101*c* and the photosensitive drums 101*d* (step S2003). Then, the motor controller 204 compares between the detected phase difference and the phase difference threshold value (step S2004).

If the rotational phase difference is not larger than the phase difference threshold value (NO to the step S2004), the motor controller 204 notifies the printer controller 201 that separation control is not required. According to the notification, the printer controller 201 refrains from performing the separation control of the photosensitive drums 101*a* to 101*d* and the intermediate transfer belt 104, and the motor controller 204 causes the rotational phases of the respective photosensitive drums 101*a* to 101*d* to match each other, in the state where the photosensitive drums 101*a* to 101*d* and the intermediate transfer belt 104 are in contact with each other (step S2005).

Then, after completion of rotational phase adjustment (step S2006), i.e. after receiving a notification of completion of the phase control, the printer controller 201 terminates the pre-processing upon completion of the startup processing (step S2007). Then, the printer controller 201 starts an image forming operation based on the print request (step S2008).

After completion of printing of a first page, the printer controller 201 determines whether or not there is a page to be printed next (step S2009). If there is a next page to be printed (YES to the step S2009), the printer controller 201 returns the process to the step S2008 and continues processing. If there is no page to be printed next (NO to the step S2009), the printer controller 201 terminates the present process.

On the other hand, if the detected rotational phase difference is larger than the phase difference threshold value (YES to the step S2004), the motor controller 204 determines that separation between the photosensitive drums 101*a* to 101*d* and the intermediate transfer belt 104 is required. Then, the motor controller 204 notifies the printer controller 201 that the separation control is required.

According to the notification, the printer controller 201 performs the separation control for separating between the photosensitive drums 101*a* to 101*d* and the intermediate transfer belt 104 (step S2010). Thereafter, the phase control start signal is delivered from the printer controller 201 to the motor controller 204. Then, the motor controller 204 causes the rotational phases of the respective photosensitive drums 101*a* to 101*d* to match each other, in the state where the photosensitive drums 101*a* to 101*d* are separated from the intermediate transfer belt 104 (step S2011).

After completion of the rotational phase adjustment (step S2012), the motor controller 204 notifies the printer controller 201 that the phase control has been completed. According to the notification, the printer controller 201 brings the photosensitive drums 101*a* to 101*d* into contact with the intermediate transfer belt 104 (step S2013), and then proceeds to the step S2007.

As described above, according to the present embodiment, in performing the rotational phase control of the photosensitive drums 101*a* to 101*d*, it is determined depending on the magnitude of the rotational phase difference whether or not to separate the photosensitive drums 101*a* to 101*d* and the intermediate transfer belt 104 from each other. Therefore, it is possible to prevent degradation of image quality and reduce time required for rotational phase control. Further, according to the variation of the present embodiment, the rotational phase control is performed during the pre-processing before starting an image forming operation, and hence when the rotational phase shift (i.e. the rotational phase difference) between the photosensitive drums 101*a* to 101*d* is small, it is possible to reduce a time period taken to complete printing of a first page and perform an image forming operation without hardly causing degradation of image quality.

In the above-described embodiment, control of matching the rotational phases of the respective photosensitive drums 101*a* to 101*d* is performed in the state where the intermediate transfer belt 104 are in contact with or separated from the photosensitive drums 101*a* to 101*d* depending on the rotational phase difference between the photosensitive drums 101*a* to 101*d*. However, if priority is given to the service lives of the photosensitive drums 101*a* to 101*d* and the intermediate transfer belt 104, the motor controller 204 may perform the rotational phase control in the state where the intermediate transfer belt 104 are separated from the photosensitive drums 101*a* to 101*d* by the printer controller 201. Further, if priority is given to the image output speed, the motor controller 204 may perform the rotational phase control with the intermediate transfer belt 104 held in contact with the photosensitive drums 101*a* to 101*d* by the printer controller 201. In this case, a first mode in which service lives are given priority and a second mode in which image output speed is given priority may be provided such that one of the first mode and the second mode can be selected e.g. via the console section 206.

As is apparent from the above description, the separation solenoid 120 appearing in FIG. 2 functions as a contact unit, and the phase detection sensors 103*a* and 103*d* and the motor controller 204 function as a phase difference detection unit. Further, the motor controller 204 and the printer controller 201 function as a control unit. The console section 206 functions as a selection unit.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims priority from Japanese Patent Application No. 2010-172199 filed Jul. 30, 2010, which is hereby incorporated by reference herein in its entirety.

What is claimed is:

1. An image forming apparatus comprising:

a first image bearing member configured to have a toner image formed thereon;

a second image bearing member configured to have a toner image formed thereon which is different in color from the toner image formed on said first image bearing member;

a transfer member configured to have the toner image formed on said first image bearing member and the toner image formed on said second image bearing member transferred thereon in superimposed relation;

a contact unit configured to bring said transfer member into contact with said first image bearing member and said second image bearing member;

a phase difference detection unit configured to detect a rotational phase difference between said first image bearing member and said second image bearing member; and a control unit configured to perform phase control for bringing a phase of said first image bearing member and a phase of said second image bearing member into predetermined relation, based on the rotational phase difference detected by said phase difference detection unit, wherein said control unit performs the phase control in a state where said transfer member does not contact with said first image bearing member and said second image bearing member in a case where the rotational phase difference is out of a predetermined range, and performs the phase control in a state where said transfer member contacts with said first image bearing member and said second image bearing member in a case where the rotational phase difference is within the predetermined range.

2. The image forming apparatus according to claim 1, wherein said control unit performs the phase control during post-processing executed after performing image formation.

3. The image forming apparatus according to claim 1, wherein said control unit performs the phase control during pre-processing executed prior to performing image formation.

4. The image forming apparatus according to claim 1, wherein said control unit performs the phase control in the case of no image to be formed next during performing image formation.

5. The image forming apparatus according to claim 1, wherein said control unit performs, when a instruction for performing image formation is received, the phase control before image formation is started.

6. The image forming apparatus according to claim 1, further comprising a plurality of image bearing members which are not used for monochrome image formation, wherein said plurality of image bearing members are driven by a single motor which is different from a motor for driving said first image bearing member, said plurality of image bearing members are assembled so as to rotate in a one rotational phase, and said plurality of image bearing members includes said second image bearing member.

* * * * *